US005404676A

United States Patent [19]

Devlin

[11] Patent Number: 5,404,676

[45] Date of Patent: Apr. 11, 1995

[54] WATERTIGHT PIT COVER

[75] Inventor: Mike Devlin, Anaheim, Calif.

[73] Assignee: Dabico, Inc., Costa Mesa, Calif.

[21] Appl. No.: 47,921

[22] Filed: Apr. 19, 1993

[51] Int. Cl.[6] ..... E06B 3/32; E02D 29/14

[52] U.S. Cl. ..... 49/463; 404/25

[58] Field of Search ..... 49/466, 463, 495.1; 404/25, 26; 52/20, 21

[56] References Cited

U.S. PATENT DOCUMENTS

| | | | |
|---|---|---|---|
| 2,190,954 | 2/1940 | Stickel | 49/495.1 X |
| 3,171,166 | 3/1965 | Heimann et al. | 49/495.1 |
| 3,672,103 | 6/1972 | Kost | 52/20 |
| 3,945,329 | 3/1976 | Bywater | 49/463 X |
| 4,592,674 | 6/1986 | Baliva | 404/25 |
| 4,593,714 | 6/1986 | Madden . | |
| 4,597,692 | 7/1986 | Gruenwald | 404/25 |
| 4,706,718 | 11/1987 | Milo | 404/26 X |
| 4,742,646 | 5/1988 | Kekrli | 49/495.1 X |
| 4,850,389 | 7/1989 | Moss | 52/20 X |
| 4,976,568 | 12/1990 | Hess | 404/25 X |
| 5,056,955 | 10/1991 | Spiess et al. | 404/25 |

*Primary Examiner*—Philip C. Kannan
*Attorney, Agent, or Firm*—Charles H. Thomas

[57] ABSTRACT

A subsurface chamber formed by a pit and buried beneath a surface across which aircraft travel is provided with an effective sealing system at its opening. The opening to the chamber is formed by a mounting frame adapted to receive and seat a lid therewithin. The mounting frame is formed with a frustoconical wall tapering downwardly and inwardly toward the opening into the chamber. The lid is provided with a peripheral rim having a plurality of flexible, resilient, annular, water impervious sealing flaps that extend outwardly from the lid an which are vertically spaced from each other. As the lid is lowered into position, the sealing flaps do not scrape or slide against the frustoconical wall of the mounting frame. Rather, they establish contact with the frame only as the lid approaches to within one quarter inch of its fully seated position. With this contact the sealing flaps are deflected upwardly to form a liquid tight seal against the mounting frame without frictional abrasion against the wall of the frame.

14 Claims, 1 Drawing Sheet

WATERTIGHT PIT COVER

BACKGROUND OF THE INVENTION

1. Field of the Invention

The present invention relates to a sealing system for heavy lids for pits used in servicing aircraft at docking, loading and fueling terminals.

2. Description of the Prior Art

At modern aircraft terminals servicing of aircraft on the ground is frequently performed using prefabricated pits which are installed at aircraft docking, fueling and loading areas beneath the surface of the tarmac across which aircraft travel during docking and departure maneuvers. The pits are typically formed of fiberglass, steel or aluminum and are constructed as enclosures with surrounding walls, and an access lid seated in an opening at the top of the walls. The pits are installed below the surfaces of loading and refueling aprons at aircraft terminals, remote parking locations and at maintenance bases.

The purpose of the pits is to allow ground support functions to be carried out from subsurface enclosures. These ground support functions include the provision of fuel, the provision of electricity to the aircraft while it is in the docking area, the provision of air for cooling the aircraft interior, the provision of pressurized air for starting the aircraft engines, and for other aircraft support activities on-the ground. The use of subsurface pits eliminates the need for mobile trucks, carts and other vehicles which are otherwise present in the loading area and which interfere with the arrival and departure of aircraft in the vicinity of a loading gate. The use of subsurface pits also allows the provision of fuel, power, cooling and pressurized air, and other supplies from a central location. The necessary fluid supplies and electrical power can be generated or stored with a greater efficiency at a central location, as contrasted with mobile generating or supply vehicles.

The pits located below the aircraft terminal area house valves, junction boxes, cooling air terminations and other terminal equipment that is temporarily connected to an aircraft that has been docked. Umbilical pipes and lines, otherwise housed within the pits, are withdrawn from the pits through hatches therein and are coupled to a docked aircraft to supply it with fuel, air for cooling the aircraft interior, pressurized air for starting the engines, and electrical power.

The pits are constructed with either hinged or totally removable lids that can be moved between open positions allowing access to the pits and closed positions which are flush with the surfaces of the docking, loading or refueling areas across which aircraft travel and beneath which the pits are mounted. Because the pits are located below grade, there is a tendency for water, spilled fuel, dust and debris to fall into the pits through the interstitial cracks surrounding the pit lids within the frames in which the Pits are mounted. Since these vertical interstitial gaps represent a point below grade, rainwater and melting snow carries both liquid and solid debris into the gaps surrounding the pit lids. The liquid flows down into the pits carrying some of the debris with it. Also, whenever a pit lid is opened any debris remaining on the shoulder supporting the lid frame is likely to fall into the pit as well.

The entry of dirt, debris and unwanted liquid into the pit enclosure can create problems. Such contaminants accelerate rusting and contribute to jamming of mechanical mechanisms, such as valves and latches. Also, dirt and debris tend to obscure the visibility of dials on pressure and volume gauges, and on dials indicating voltage levels. and other readings.

To prevent unwanted contaminants from entering a subsurface pit through the interstitial gaps between the pit lid and the surrounding frame, various sealing systems have been employed. Such conventional sealing systems employ "wiper" seals in which a peripheral seal around a pit lid drags against the surrounding lid mounting frame wall as the lid is seated and unseated relative to the mounting frame. The effect of friction against the mounting frame wall rapidly degrades the integrity of the seal and significantly detracts from the effectiveness of the seal in a relatively short period of time. Thus, conventional pit lid sealing systems have proven unsatisfactory.

Another problem with conventional pit lid sealing systems is that when the seals do degrade they are difficult to replace. Conventional seals are formed of an elastomeric material secured by an adhesive to the edge of the pit lids. When conventional seals become worn and start to leak, they must be pulled away from the lid and the old adhesive must be removed from the edge of the lid before a new replacement seal can be installed. The removal of the old adhesive is a time consuming process, so that worn and deteriorated seals are often not replaced as frequently as they should be.

SUMMARY OF THE INVENTION

The present invention involves a unique sealing system for a subsurface aircraft servicing pit which maintains its integrity even with prolonged use. The reason the sealing system of the present invention is so effective is because the seals employed are not dragged or wiped against the surrounding mounting frame wall surfaces. To the contrary, the seals of the present invention make contact with the mounting frame wall only when the lid comes to within one quarter of an inch of being seated on the mounting frame shoulder. When the seals of the invention do make contact with the lid frame, they are not dragged across it and abraded, but to the contrary are merely resiliently deflected upwardly.

The unique configuration of the pit lid sealing system of the present invention provides an effective seal even when little vertical sealing pressure is applied as when the lid is seated. That is, when the lid is lowered into position the only pressure applied to effectuate a seal is the force of resiliency of the seal against the mounting frame wall. In a conventional sealing system in which the mounting frame wall is a vertical, annular surface surrounding the pit lid, a seal about the lid below the level of the upper surface of the frame must necessarily slide against the mounting frame wall as the lid enters the frame. This sliding action continues until the lid is fully seated.

However, if the pit lid wall is formed as a frustoconical surface tapering downwardly and inwardly toward the center of the pit opening, and if the edge of the pit lid is tapered to match that of the tapered mounting frame wall, contact between the seal and the frustoconical mounting frame wall is not established until the lid is within a fraction of an inch of being fully seated. The greater the departure of the angle of taper of the frustoconical wall surface relative to vertical, the closer the lid can approach its fully seated position before the seals first contact the wall. The seals are therefore merely deflected upwardly a fraction of an inch as the lid is seated, and are not scraped against the mounting frame wall surface. This prolongs the integrity of the resilient seals at the outer periphery of the pit lid.

In one broad aspect the present invention may be considered to be an improvement in an access lid assembly having a lid that is able to withstand the weight applied by the tires of an aircraft traveling thereacross and an annular mounting frame located atop a subsurface chamber used to service aircraft and defining an opening therewithin and in which the lid is removably seated. According to the improvement of the invention, the mounting frame has a wall tapering downwardly and inwardly. The lid includes a peripheral rim having a plurality of vertically separated, resilient, flexible, radially extending sealing flaps disposed about the entire perimeter of the lid. The flaps are deflected upwardly by contact with the wall of the mounting frame to form a seal therewith when the lid is seated in the frame. Preferably, the opening in the mounting frame is circular and the mounting frame wall and the peripheral edge of the lid are both formed in a matching frustoconical configuration. The frustoconical wall and the edge and rim of the pit lid preferably have a taper of at least about ten degrees and preferably about fifteen degrees relative to vertical.

In another broad aspect the invention may be considered to be an improvement in a subsurface chamber defined below a surface across which aircraft travel and having an access opening frame located at the surface and a lid capable of withstanding the weight from the tires of an aircraft traveling thereacross removably seated in the frame. According to the improvement of the invention, the access opening frame defines a wall tapering downwardly and inwardly from the paved surface. The lid has a peripheral rim with a plurality of annular, flexible resilient, liquid impervious sealing flaps extending outwardly from the lid about the entire perimeter thereof. The flaps are vertically spaced from each other and reside in contact with and are deflected upwardly by the access opening frame wall to form a seal therewith when the lid is seated in the frame. Preferably the rim is formed as a compression molded, annular jacket of a flexible resilient material that is disposed about and grips the periphery of the lid. The uppermost of the sealing flaps is at a level proximate to the level of the surface beneath which the subsurface chamber is mounted.

In still another broad aspect the invention may be considered to be an improvement to a pit for servicing an aircraft located below a surface across which aircraft travel and having an access opening formed with a lid mounting frame and a lid capable of withstanding the weight of aircraft traveling thereacross and adapted for seating in the mounting frame. According to the improvement of the invention, the mounting frame is formed with a wall surrounding the opening and sloping downwardly and inwardly thereto from the surface. According to the invention a rim is disposed about the periphery of the lid and has a plurality of annular flaps formed of a flexible resilient water impervious material extending radially therefrom. The flaps are deflected upwardly to form a seal against the mounting frame wall about the entire perimeter of the lid when the lid is seated in the mounting frame.

Preferably the flaps extend radially from the lid a distance such that they contact the mounting frame wall only when the lid is within one quarter of an inch of being seated in the mounting frame. Preferably also, the mounting frame defines a horizontal, annular bearing ledge at the foot of the mounting frame wall. The ledge supports the lid thereon. The rim of the lid has a radially projecting base that is adapted to seat against the foot of the mounting frame wall when the lid is seated in the mounting frame. This serves to center the lid within the mounting frame.

The sealing arrangement of the invention is designed to provide an effective seal where no vertical sealing pressure is applied when the lid is closed, beyond the weight of the lid itself. In the dirty environment in which the sealing system is used, namely as a seal for a lid of a subsurface chamber beneath a surface across which aircraft travel, a system with multiple sealing is required to prevent the buildup of dirt and debris around the edge of the lid, as well as to ensure a liquid tight seal.

In the system of the invention an effective seal is attained when the lid is closed even when there is a minimum of downward pressure. Because the wall of the mounting frame is tapered, the flaps that extend radially from the peripheral edge of the lid make contact with the mounting frame wall only when the lid approaches to within one quarter inch of its seated position as it is lowered into the mounting frame. Also, the tapered wall of the mounting frame allows the flaps to be deflected upwardly rather than scraped against the mounting frame wall. Thus, the wear on the seal provided by the flaps is negligible and the flaps are able to maintain an effective seal with a high degree of integrity and without any significant abrasion for an extended period of time. Furthermore, the fact that the radial flaps are deflected, rather than dragged in frictional engagement with the wall of the mounting frame, allows a certain amount of accretions to build up on the wall of the frame without compromising the integrity of the seal and without degrading the seal as would occur if the flaps were scraped or dragged against these accretions.

While any number of a plurality of sealing flaps may be provided, the system of the invention may employ three of such flaps. The uppermost of these flaps is located proximate to the upper extremity of the mounting frame wall. This upper seal provides for dirt exclusion and is preferably located within one quarter inch of the top, horizontal surface of the lid, which lies in substantially the same plane as the paved surface beneath which the pit is installed.

Although the sealing flaps are long enough to establish contact with the inclined mounting frame wall even when the lid is slightly off center within the opening, the peripheral edge of the rim at the underside of the lid is preferably provided with a base that projects outwardly a short distance, away from the center of the lid. By providing the lower peripheral edge of the lid with a radially projecting base that seats snugly against the mounting frame wall at-the intersection between the inclined mounting frame wall and the bearing ledge at the foot of the wall, the lid is automatically centered within the mounting frame opening as it is lowered into position. The resilient flaps on the peripheral edge of the lid are long enough to accommodate some misalignment, but a concentric fit lengthens the life of the seals appreciably.

One important advantage of the invention is that the rim can be replaced very easily should it eventually become worn or damaged. The rim bearing the outwardly projecting flaps is formed of an elastomeric material in an annular loop that extends around and elastically grips the entire perimeter of the lid. Since the elastic force of the rim holds it in position, the seal provided does not require an adhesive for attachment to the lid. In conventional lid sealing arrangements the seal must be attached to the lid using an adhesive. Once the seal becomes worn or damaged with use, it can be replaced only by stripping the old sealing material away and removing the remnants of the adhesive from the edge of the lid. These remnants of old adhesive must be arduously chipped or dug away. Because of the difficulty in stripping away the old adhesive, replacement of conventional seals is often deferred, thus resulting in leaks into the pit. With the present invention, on the other hand, a worn or defective rim can be stretched and pulled off the edge of the lid and replaced with a new rim in a matter of seconds. Thus, replacement is far simpler than with prior lid sealing systems, and is more likely to be performed when required than with conventional pit lid sealing systems.

The invention may be described with greater clarity and particularity by reference to the accompanying drawings.

DESCRIPTION OF THE EMBODIMENT

Figure 1:
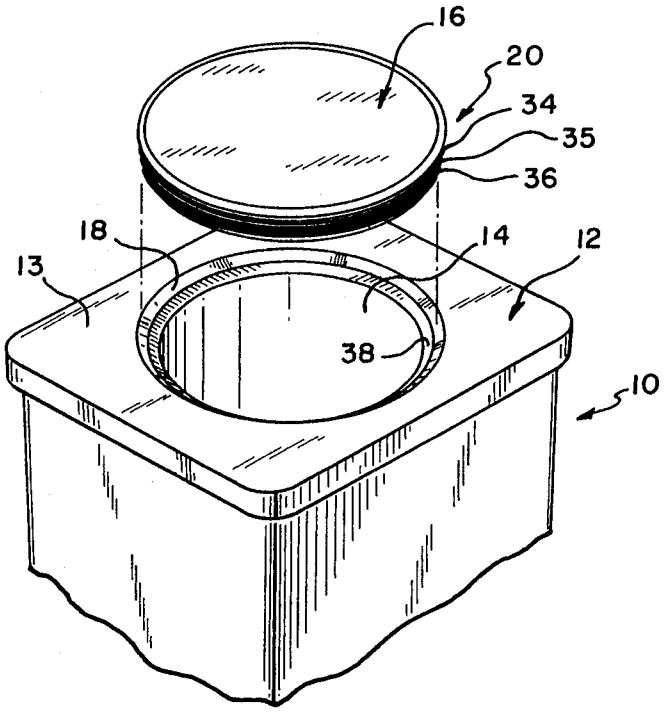
FIG 1 is a perspective view of the improved pit of the invention.

FIG. 1 illustrates an otherwise conventional prefabricated fiberglass pit 10 for servicing an aircraft located below a tarmac surface across which aircraft travel. The pit 10 may, for example, of the type described in U.S. Pat. No. 4,850,389. The pit 10 is hollow and defines therewithin a subsurface chamber for housing fuel terminations, electrical terminations, pressurized air terminations, and other apparatus employed in the servicing of aircraft while the aircraft is on the ground.

The pit 10 has a mounting frame 12 which defines an upper, horizontal surface 13 and a circular access opening 14 therewithin. The pit 10 also includes a generally disc-shaded aluminum or steel lid 16 that is capable of withstanding the weight of an aircraft traveling thereacross. The lid 16 is adapted for seating in the mounting frame 12. As illustrated in the drawings, the mounting frame 12 is formed with a frustoconical wall 18 that surrounds the opening 14 and slopes downwardly and inwardly thereto from the surface 13.

Figure 2:
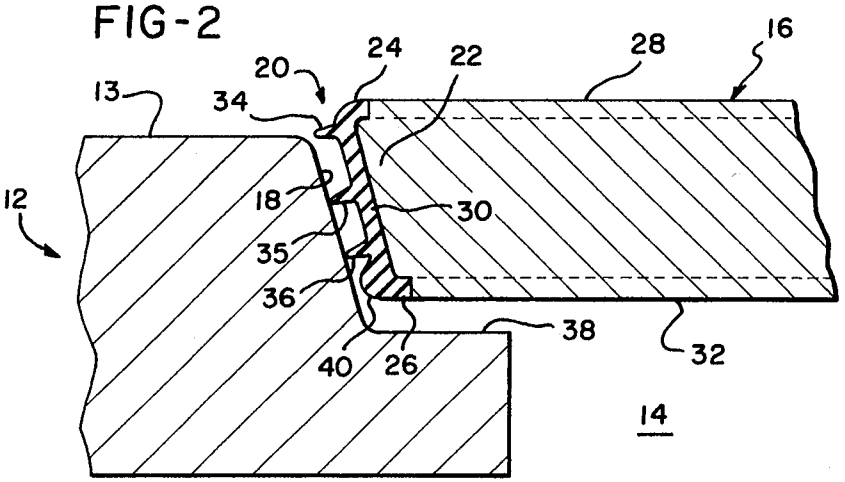
FIG. 2 is a sectional elevational detail showing the improved sealing mechanism of the invention as the lid is being lowered into a seated position within a mounting frame at the top of the pit of FIG. 1.
Figure 3:
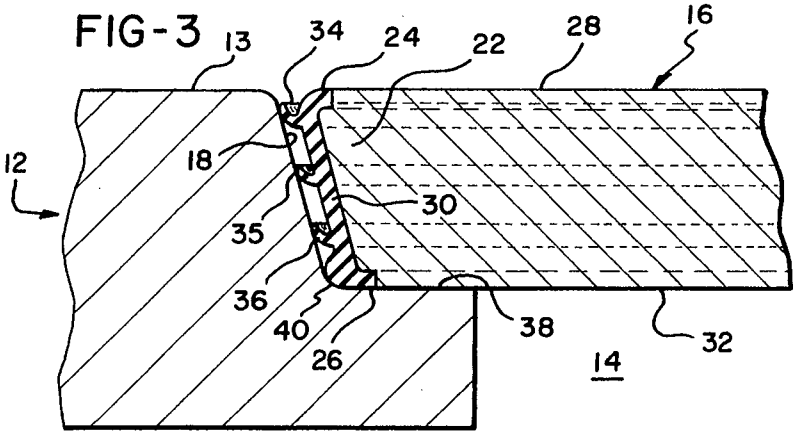
FIG. 3 is a sectional elevational detail illustrating the edge of the lid fully seated in the mounting frame of FIG. 2.

As best illustrated in FIGS. 2 and 3, the lid 16 has a rim 20 disposed about its periphery. The lid 16 is of a frustoconical configuration and the slope of its peripheral edge 30 matches that of the frame wall 18. The rim 20 is formed as a jacket of a flexible, resilient material, such a Buna-N rubber. The rim 20 is disposed about and grips the periphery 22 of the lid and has a pair of upper and lower radially inwardly extending lips 24 and 26 which seat in corresponding annular grooves at the transition between the upper face 28 and the outer peripheral edge 30 of the lid 16 and between the lower face 32 and the outer peripheral edge 30 of the lid 16. At least one of the lips 24 at the rim 20 must be elastically distended in order for the rim 20 to be installed on the metal structure of the lid 16.

The rim 20 is preferably formed as an endless, annular loop of elastomeric materials that is elastically stretched to surround and grip the peripheral edge 30 of the pit lid 16. When the rim 20 ultimately becomes worn or damaged, it can be replaced very easily. The lip 24 or 26 is merely stretched so that the rim 20 can be pulled off of the edge 30 of the lid 16. A replacement rim 20 is then installed in the same manner. Because no adhesive is required to secure the rim 20 to the pit lid 16, replacement of the rim 20 and the seals formed by it can be performed in only a matter of seconds.

The rim 20 also has three annular flaps 34, 35 and 36 that extend radially from the peripheral edge 30 of the lid 16. As illustrated in FIG. 3, the flaps 34, 35 and 36 are deflected resiliently upwardly to form a seal against the mounting frame wall 18 about the entire perimeter of the lid 16 when the lid 16 is fully seated in the mounting frame 12.

The frustoconical wall 18 has a taper of about fifteen degrees relative to vertical, or about seventy five degrees relative to the horizontal upper surface 13 of the mounting frame 12. This taper or incline is sufficient to allow the flaps 34 and 36 to be deflected resiliently upwardly, rather than slide along the mounting wall surface 18. As shown in FIG. 2, the flaps 34, 35 and 36 extend from the lid 16 a distance such that they first contact the frustoconical wall 18 only when the lid 16 has been lowered to within about one quarter of an inch of its fully seated position, which is illustrated in FIG. 3.

As best illustrated in FIGS. 1 and 2, the mounting frame 12 is formed with an annular, horizontally disposed bearing ledge 38 at the bottom or foot of the frustoconical wall 18. The bearing ledge 38 forms a shoulder which supports the peripheral margin 22 of the lid 16 throughout an annular interface therebetween when the lid 16 is seated as shown in FIG. 3. When the lid 16 is seated its upper surface 28 is substantially level with the upper surface 13 of the mounting frame 12.

The peripheral edge 30 of the lid 16 is tapered to match the taper of the frustoconical wall 18 of the mounting frame 12. That is, the peripheral edge 30 of the lid 16 is likewise tapered at an angle of about fifteen degrees from the vertical. This ensures an approximately equal amount of deflection of the sealing flaps 34, 35 and 36 when the lid 16 is seated in the mounting frame 12 as depicted in FIG. 3.

The uppermost sealing flap 34 is located within one quarter inch of the upper surface 28 of the lid 16 so that it resides at a level proximate to the upper extremity of the frustoconical wall 18 when the lid 16 is seated in the mounting frame 12, as illustrated in FIG. 3. By providing an upper seal closely proximate to the upper horizontal surface 11 of the mounting frame 12, the sealing system of the invention largely prevents debris and contaminants from entering into the interstitial gap between the body of the rim 20 and the frustoconical surface 18.

In addition to the sealing flaps 34, 35 and 36, the rim 20 also is formed with a radially projecting rounded protruding base 40 surrounding the lower extremity of the lid 16 at the undersurface 32 thereof. The base 40 projects laterally outwardly from the tapered edge 30 of the lid 16 and seats snugly against the bearing shoulder formed where the bearing ledge 38 meets the foot of the frustoconical mounting wall surface 18. The base 40 thereby serves to center the lid 16 within the access opening 14 in the mounting frame 12.

As the lid 16 is lowered into position in the mounting frame 18 atop the opening 14, none of the resilient sealing flaps 34, 35 or 36 makes contact with the mounting frame 12 until the lid 16 is within one quarter of an inch of being fully seated, as illustrated in FIG. 2. Only at this time do the sealing flaps 35 and 36 first make contact with the frustoconical mounting frame wall 18. Because there is such a slight additional downward movement of the lid 16 from the time of initial contact between the mounting flaps 35 and 36 and the frustoconical wall 18, there is little or no friction between the sealing flaps 34, 35 and 36 as the lid 16 moves into its completely seated position depicted in FIG. 3. To the contrary, the outermost extremities of the sealing flaps 34, 35 and 36 are merely resiliently deflected upwardly without abrading against wall 18 as the lid 16 is lowered the remaining distance until the undersurface 32 thereof resides in contact with and rests atop the bearing ledge 38, as shown in FIG. 3.

The sealing system of the invention provides a simple but effective arrangement for forming a liquid tight seal between the lid 16 and the mounting frame 12. Because there is negligible friction in the movement of the sealing flaps 34, 35 and 36 against the frustoconical wall 18, the seals established across the annular interstitial gap between the lid 16 and the wall 18 of the mounting frame 12 have a high degree of integrity despite prolonged use.

Undoubtedly, numerous variations and modifications of the invention will become readily apparent to those familiar with the construction of aircraft servicing pits. For example, the mounting frame 12 could be provided with a collar formed of a resilient material having sealing flaps extending radially inwardly toward the peripheral edge of the lid. Also, while the embodiment illustrated employs only three sealing flaps, two, four or any greater number of sealing flaps can be employed to achieve the requisite sealing integrity. Accordingly, the scope of the invention should not be construed as limited to the particular embodiment illustrated and described.

I claim:

1. In an access lid assembly having a lid of rigid construction throughout that is able to withstand the weight applied by the tires of an aircraft traveling thereacross and an annular mounting frame located atop a subsurface chamber used to service aircraft and defining an opening therewithin and in which said lid is removably seated, the improvement wherein said mounting frame has a wall tapering downwardly and inwardly at an angle of at least about ten degrees relative to vertical and further comprising a peripheral rim formed as an elastomeric, annular loop which is elastically stretched and removably disposed about said lid to grip said lid as an encircling jacket, and having a plurality of vertically separated, resilient, flexible, radially outwardly extending sealing flaps disposed about the entire perimeter of said lid wherein said flaps are deflected upwardly by contact with said wall of said mounting frame to form a seal therewith when said lid is seated in said frame.

2. An access lid assembly according to claim 1 wherein said wall has a taper of about fifteen degrees relative to vertical.

3. In an access lid assembly having a lid with a circular perimeter that is able to withstand the weight applied by the tires of an aircraft traveling thereacross and an annular mounting frame located atop a subsurface chamber used to service aircraft and defining a circular opening therewithin and in which said lid is removable seated, the improvement wherein said mounting frame has a wall of frustoconical configuration tapering downwardly and inwardly at an angle of at least about ten degrees relative to vertical and further comprising a peripheral rim on said lid having a plurality of vertically separated, resilient, flexible, radially outwardly extending sealing flaps disposed about the entire perimeter of said lid wherein said flaps extend radially from said lid a distance such that they contact said frustoconical wall only when said lid is within one quarter of an inch of being seated in said mounting frame and are deflected upwardly by contact with said wall of said mounting frame to form a seal therewith when said lid is seated in said frame.

4. An access lid assembly according to claim 3 wherein said mounting frame is formed with an annular, horizontally disposed bearing ledge at the bottom of said frustoconical wall, and said lid has a peripheral edge tapered downwardly and inwardly at the same angle as said frustoconical wall of said mounting frame.

5. In an access lid assembly having a lid with a circular perimeter that is able to withstand the weight applied by the tires of an aircraft traveling thereacross and an annular mounting frame located atop a subsurface chamber used to service aircraft and defining a circular opening therewithin and in which said lid is removably seated, the improvement therein said mounting frame has a wall of frustoconical configuration tapering downwardly and inwardly at an angle of at least about ten degrees relative to vertical and further comprising a peripheral rim on said lid having a plurality of vertically separated, resilient, flexible, radially outwardly extending sealing flaps disposed about the entire perimeter of said lid wherein said flaps are deflected upwardly by contact with said wall of said mounting frame to form a seal therewith when said lid is seated in said frame wherein the uppermost of said flaps is at a level proximate to the upper extremity of said frustoconical wall of said mounting frame when said lid is seated therein.

6. In a subsurface chamber defined below a surface across which aircraft travel and having an access opening frame located at said surface and a lid capable of withstanding the weight from the tires of an aircraft traveling thereacross removably seatable in said frame, the improvement wherein said access opening frame defines a wall tapering downwardly and inwardly from said surface, wherein said lid and said wall of said access opening are both of a frustoconical configuration, and said lid has a peripheral rim 3with three annular, flexible, resilient, liquid impervious sealing flaps extending outwardly therefrom about the entire perimeter thereof the uppermost of said sealing flaps being located proximate the level of said surface, and said flaps are vertically spaced from each other and reside in contact with and are deflected upwardly by said access opening frame wall to form a seal therewith when said lid is seated in said frame.

7. In a pit for servicing aircraft located below a surface across which aircraft travel and having an access opening formed within a lid mounting frame and a lid having a rigid construction throughout and capable of withstanding the weight of aircraft traveling thereacross adapted for seating in said mounting frame, the improvement wherein said mounting frame is formed with a wall surrounding said opening and sloping downwardly and inwardly thereto from said surface at an angle of at least about ten degrees relative to vertical, and further comprising a rim disposed about the periphery of said lid and wherein said rim is formed as a removable jacket of a flexible, resilient material that is disposed about and elastically distended to grip the periphery of said lid wherein said rim has a plurality of annular flaps formed of a flexible, resilient water impervious material extending outwardly therefrom, and said flaps are deflected resiliently upwardly to form a seal against said mounting frame wall about the entire perimeter of said lid when said lid is seated in said mounting frame.

8. A pit according to claim 7 wherein said lid and said wall of said access opening are both of a frustoconical configuration.

9. A pit according to claim 8 wherein said access opening frame defines a bearing shoulder at the foot of said frustoconical wall and said rim of said lid has a peripheral edge that is tapered to match the taper of said frustoconical access opening frame wall, and said rim also has a base at the lower extremity of said lid that projects laterally outwardly therefrom and seats snugly against said bearing shoulder, thereby centering said lid within said access opening frame.

10. A pit according to claim 8 wherein said wall of said frame is tapered at an angle of about fifteen degrees from vertical.

11. A pit according to claim 7 wherein said lid and said mounting frame wall are both formed in a frustoconical configuration.

12. A pit according to claim 11 wherein said lid has a peripheral edge that is tapered to match the taper of said frustoconical wall of said mounting frame.

13. A pit according to claim 11 wherein said frustoconical wall of said mounting frame and said peripheral edge of said lid are both tapered at an angle of at least about fifteen degrees from vertical.

14. A pit according to claim 11 wherein said mounting frame defines a horizontal, annular bearing ledge at the foot of said frustoconical wall, and wherein said bearing ledge supports said lid thereon and said rim of said lid has a radially projecting base that seats against the foot of said frustoconical wall when said lid is seated in said mounting frame.

* * * * *